US008561565B2

(12) United States Patent
Zimmerman

(10) Patent No.: US 8,561,565 B2
(45) Date of Patent: Oct. 22, 2013

(54) ANCHORS FOR MOORING OF OBJECTS IN A MARINE ENVIRONMENT

(75) Inventor: Evan Zimmerman, Houston, TX (US)

(73) Assignee: Delmar Systems, Inc., Broussard, LA (US)

( * ) Notice: Subject to any disclaimer, the term of this patent is extended or adjusted under 35 U.S.C. 154(b) by 0 days.

(21) Appl. No.: 12/664,900

(22) PCT Filed: Aug. 29, 2008

(86) PCT No.: PCT/US2008/074916

§ 371 (c)(1),
(2), (4) Date: Dec. 16, 2009

(87) PCT Pub. No.: WO2009/032799

PCT Pub. Date: Mar. 12, 2009

(65) Prior Publication Data

US 2010/0192830 A1 Aug. 5, 2010

Related U.S. Application Data

(60) Provisional application No. 60/970,017, filed on Sep. 5, 2007.

(51) Int. Cl.
*B63B 21/32* (2006.01)
*B63B 21/24* (2006.01)

(52) U.S. Cl.
USPC ..... 114/301; 114/303

(58) Field of Classification Search
USPC ..... 114/297, 295, 300, 301, 302, 303, 309
See application file for complete search history.

(56) References Cited

U.S. PATENT DOCUMENTS

| | | | | | |
|---|---|---|---|---|---|
| 2,111,443 | A * | 3/1938 | Windle | 114/300 |
| 2,204,799 | A * | 6/1940 | Filby | 114/300 |
| 2,741,209 | A * | 4/1956 | Reckendorf | 114/303 |
| 3,285,218 | A * | 11/1966 | Gilbertson et al. | 114/303 |
| 3,628,337 | A * | 12/1971 | Stepanich et al. | 405/253 |
| 3,841,255 | A * | 10/1974 | Mansfield | 114/299 |
| 4,068,609 | A * | 1/1978 | Hoetker, Jr. | 114/301 |
| 4,346,663 | A * | 8/1982 | Habib et al. | 114/295 |
| 4,380,207 | A * | 4/1983 | Nolt | 114/298 |
| 4,907,523 | A * | 3/1990 | Claesson | 114/304 |
| 6,082,284 | A * | 7/2000 | McCabe | 114/301 |
| 6,951,183 | B1 * | 10/2005 | Burback | 114/297 |
| 2007/0062434 | A1 * | 3/2007 | Degenkamp | 114/301 |

* cited by examiner

*Primary Examiner* — Stephen Avila
(74) *Attorney, Agent, or Firm* — Law Office of Jesse D. Lambert, LLC

(57) ABSTRACT

An anchor for mooring of objects in a marine environment for floating vessels, floating, grounded structures etc, which is resistant to hooking or snagging on underwater objects, such as pipelines The anchor comprises a fluke and a shank, and embeds itself into the seafloor when tension is applied to a line connected to the anchor In either a side or top profile view, the shape of the anchor presents a profile which does not have a hook shape, and therefore tends to nde over and slide off of, rather than hook onto, underwater obstructions that the anchor may be dragged over Embodiments disclosed include an anchor having a shank rigidly fixed to the fluke, and one in which the shank is rotatably connected to the fluke An elastic member, which may be a coil spring, biases the shank toward a relatively closed position with respect to the fluke.

15 Claims, 7 Drawing Sheets

ANCHORS FOR MOORING OF OBJECTS IN A MARINE ENVIRONMENT

CROSS REFERENCE TO RELATED CASES

This regular patent application claims priority to U.S. Provisional Patent Application Ser. No. 60/970,017, filed Sep. 5, 2007, for all purposes.

BACKGROUND

1. Field of Art

This invention relates to apparatus and methods for securing objects to the sea floor. With further particularity, this invention relates to apparatus and methods for embedment type anchors, which present a reduced chance of snagging or hooking upon underwater obstructions, such as pipelines and the like.

2. Description of the Preferred Embodiment

Disclosed are several embodiments of anchors (and improvements thereof), for use in mooring physical objects, including but not limited to floating vessels and structures, and/or grounded structures, typically (but not exclusively) in an marine environment. The anchors, in their various embodiments, have particular (but not exclusive) application in the anchoring of Mobile Offshore Drilling Units ("MODUs") and related production facilities used in offshore oil and gas operations.

One type of anchor in common use, and well known in the art, is called a High Holding Capacity ("HHC") anchor, which generally comprises a fluke and a shank. The fluke is generally substantially plate shaped, and in normal conditions, the fluke is substantially horizontal or aligned with the plane of the sea floor, while the shank extends generally upwardly therefrom in a plane generally at right angles to the plane of the fluke. A line, which may be the mooring line to the object being moored, is connected to the shank, and runs to the vessel or structure being moored. After lowering the HHC to the sea floor, tension applied to the line will pull the HHC anchor such that it digs into the sea floor, and eventually buries itself to some design depth. Once the anchor is set, the angle of the mooring line with respect to horizontal is generally relatively small.

Another type of anchor in common use is that known as a Vertically Loaded Anchor ("VLA"). Such anchor typically comprises a plate, the plate being connected to an installation and mooring line. The plate is pulled into the sea floor to a (typically) greater depth than an HHC anchor, and the angle of the mooring line with respect to horizontal is generally greater than the equivalent mooring line angle with an HHC anchor.

There are many pipelines and other obstructions on the sea floor. In the course of installing HHC and VLAs, it can be appreciated that if pulled over a pipeline or other obstruction, the anchor may hook onto or snag same, with potentially disastrous consequences (e.g. ruptured pipelines). Certain weather conditions, such as hurricanes, can impart sufficient forces on the moored vessel or structure so as to overcome the mooring or holding capacity of its anchors, and thereby drag anchors over long distances, again giving rise to the possibility of hooking onto a pipeline or other structure. Even if the anchor is improperly aligned, for example where an HHC anchor is positioned so that the fluke is substantially vertically (as opposed to horizontally) oriented, it is still possible for a fluke "wing" to hook a pipeline or other underwater object.

Another issue exists with conventional HHC anchors. The angle of the shank with respect to the fluke (for example, see FIG. 3, where the referenced angle is annotated as "shank angle") is fixed. This fixed angular relationship does not allow the anchor to be pulled at optimum angles for all conditions. Ideally, the angle between the shank and the fluke would increase as soil resistance and consequently mooring pull increase, and thereby permit the fluke to assume a steeper dive angle and allow greater resistance to vertical loading in the soil. Current, fixed angle HHC anchors do not permit such behavior.

Still another issue arises when anchors, namely HHC anchors, are retrieved to an MODU and vessels with outboard anchor racks. Conventional HHC anchors are stored by hooking the flukes on a rack; any anchor design which prevents such anchor mounting presents an issue with efficiently and safely carrying the anchors aboard the vessel.

SUMMARY OF THE INVENTION

Disclosed are several embodiments of the present invention, which may be used singly or in combination with one another. The present invention presents solutions to the problem of anchors hooking onto pipelines and other subsea obstructions, in the course of installation or under anchor dragging scenarios; presents a solution to the problem of controlling soil penetration behavior of HHC anchors under the influence of mooring line loads in excess of a specified design load; presents a solution to the problem of efficiently storing certain anchor designs on an AHV or MODU, and presents an anchor which may be selectively used in either fixed or rotatable shank mode.

BRIEF DESCRIPTION OF THE DRAWINGS

FIGS. 9, 10 and 11 are perspective and side views of an anchor embodying the principles of another embodiment of the present invention.

DESCRIPTION OF THE PRESENTLY PREFERRED EMBODIMENTS

Figure 1:
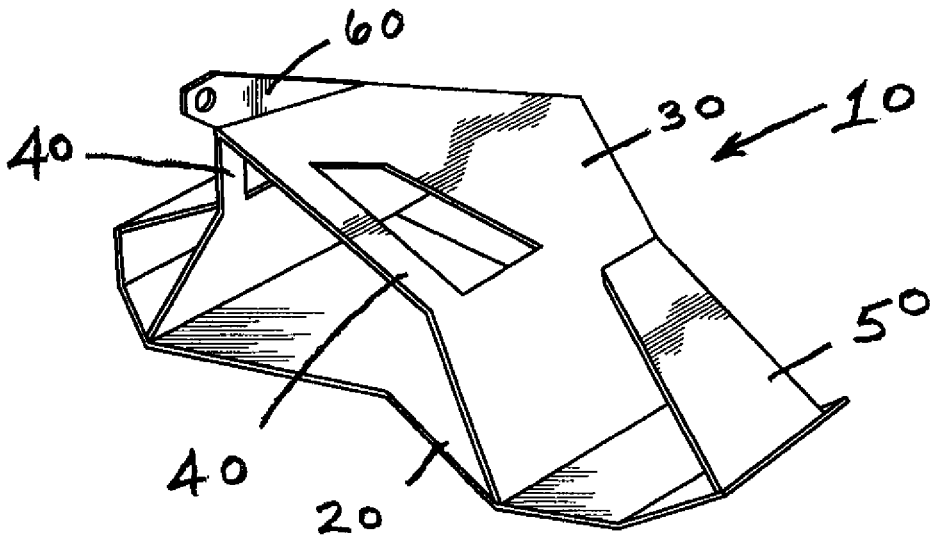
FIGS. 1-4 are perspective, side, and top views of an anchor embodying the principles of one embodiment of the present invention herein disclosed.
Figure 2:
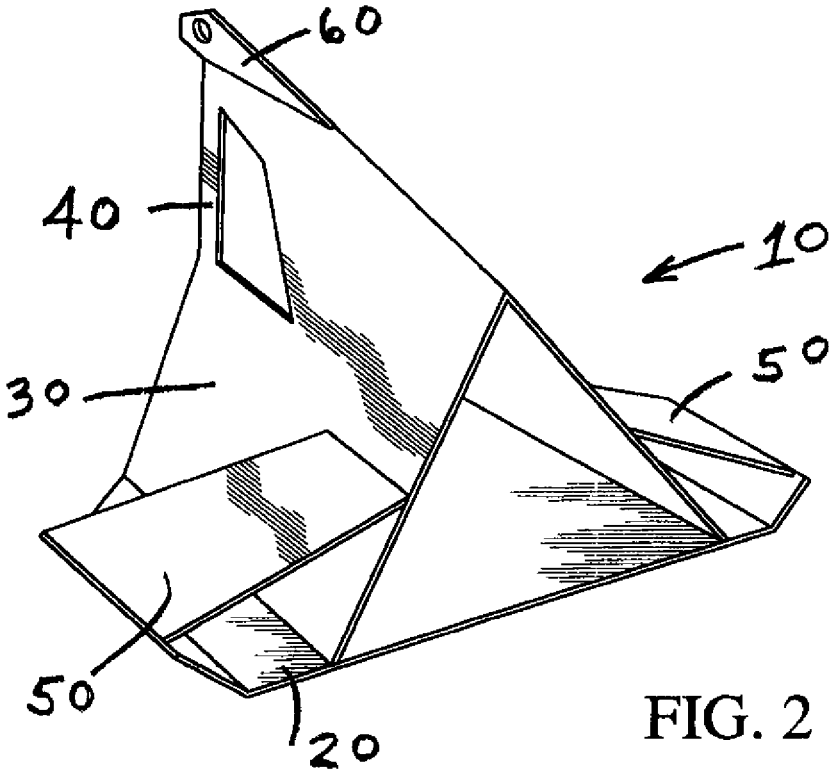
Figure 3:
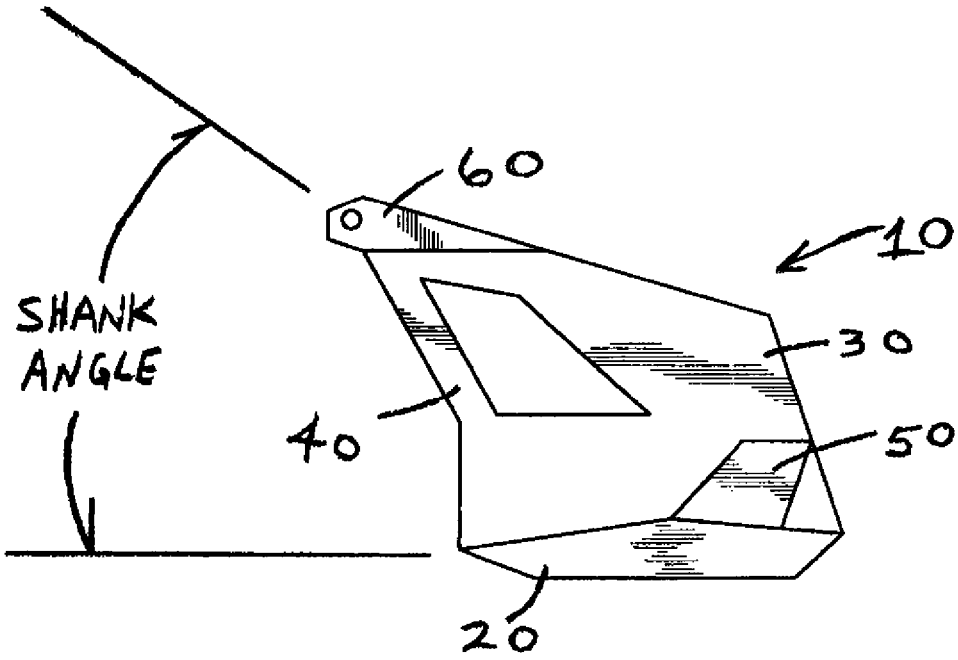
Figure 4:
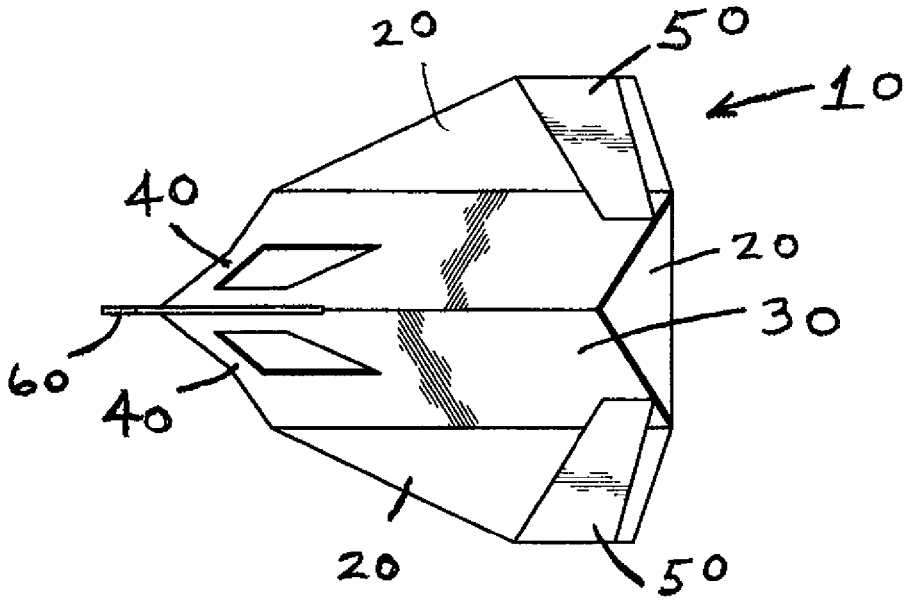

Referring to FIGS. 1-4: the snag-resistant anchor, fundamentally, has a shape, particularly evident when viewed from the side as in FIG. 3, or the top as in FIG. 4, which minimizes (if not eliminates) any "hook" shape which can potentially snag a subsea obstruction.

The anchor 10 comprises a fluke 20 joined to shank 30. Shank 30 further comprises a leading edge shank snag inhibiting member 40, which yields a side-view profile (readily seen in FIG. 3) which has little or no hook shape, therefore which greatly minimizes, if not eliminates, the possibility of snagging an underwater obstruction when the anchor is being pulled, while in its usual "upright" orientation. It is to be understood that shank inhibiting member 40 and shank 30 may effectively be formed as a single structure; said another way, shank 30 may simply have a shape which, when viewed in side profile, presents little or no hook shaped component.

Anchor 10 further comprises lateral fluke snag inhibiting members 50, extending generally from each wing of fluke 20 to a position on shank 30. The lateral fluke snag inhibiting members 50 therefore create a top-view profile (readily seen in FIG. 4) which has little or no hook shape component, therefore which greatly minimizes, if not eliminates, the possibility of snagging an underwater obstruction when the anchor is being pulled, when the anchor is essentially on its side (that is, with fluke 20 oriented substantially vertically).

As is well known in the relevant art, anchor 10 is advantageously fabricated from plate steel, with the different components joined by welding, bolting, etc. It is understood that other component shapes could also be used, for example tubular pieces for the leading edge shank snag inhibiting member 40 and the lateral fluke snag inhibiting members 50. A line, namely a mooring line, connects anchor 10 with the object being moored (typically, a vessel or other structure); typically, the mooring line is attached to anchor 10 by connection to shank 30, for example by connection to a connection plate 60 of anchor 10, typically by a padeye and shackle fixed to the mooring line. Dimensions and weight of the anchor can be varied to suit particular applications. The particular shape of the anchor components may also be varied, while retaining the attributes of minimizing, if not eliminating, any hook shaped profile, whether viewed from the top or a side.

While FIGS. 1-4 show various snag-resistant attributes on an HHC anchor, it is to be understood that the same principles, and similar structures, may be used on a VLA.

Figure 5:
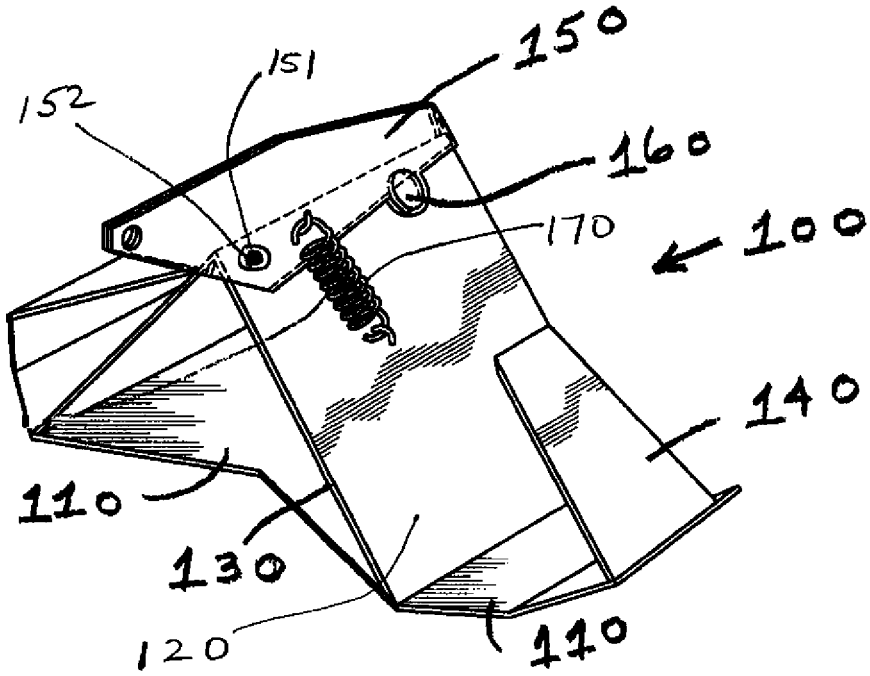
FIGS. 5, 6, and 7 are perspective and side views of an anchor embodying the principles of another embodiment of the invention herein disclosed.
Figure 6:
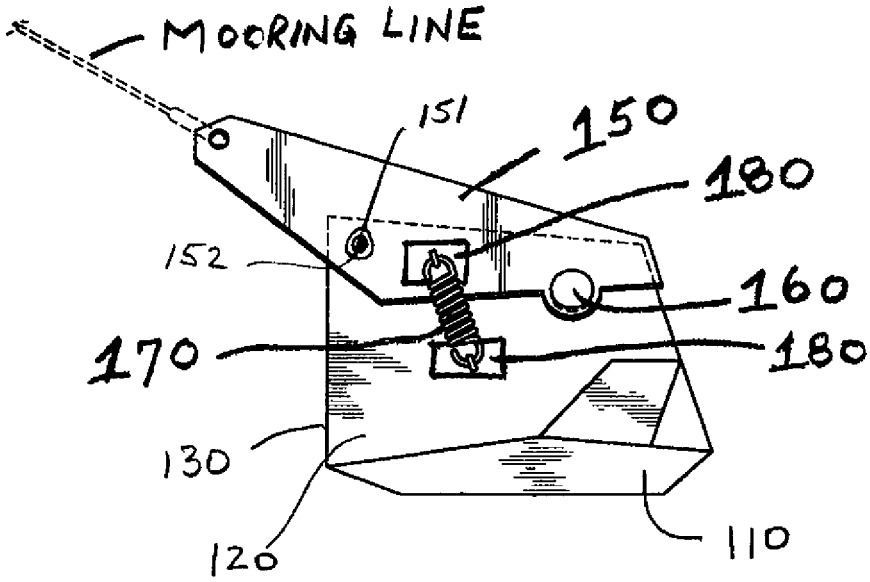
Figure 7:
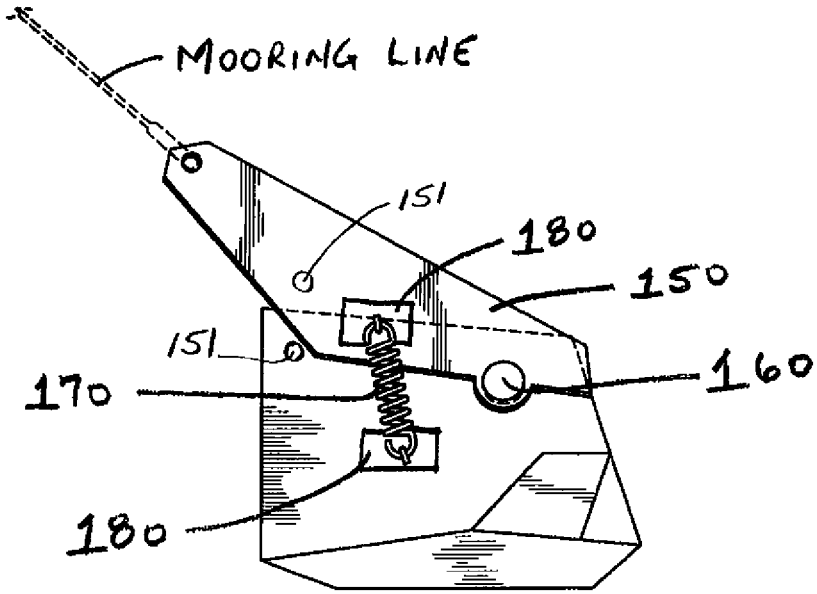

Another embodiment of the present invention is shown in FIGS. 5, 6 and 7. This embodiment comprises an anchor having a hinge or rotatable connection between the shank and the fluke, the hinge connection being elastically biased toward a first "closed" position (in which position the anchor is effectively an HHC anchor); but which permits the shank angle (as earlier described, and illustrated in FIG. 3, the angle between the fluke and shank, when viewed from the side) to increase with increasing mooring line load. The changed angle thereafter permits the anchor to behave (in terms of penetration into the soil) in a manner similar to a VLA (namely, a steeper dive angle into the soil).

Referring to FIGS. 5-7: similar to the anchor embodiment previously described, anchor 100 comprises a fluke 110 and a shank 120. Fluke 110 and shank 120 are joined by welding or other means known in the art. Similar to the first embodiment, anchor 100 may comprise a leading edge shank snag inhibiting member 130 of shank 120, which creates a side profile minimizing or eliminating any hook shape, therefore minimizes or eliminates snagging; and lateral fluke snag inhibiting members 140, in combination yielding an anchor having both side and top profiles which minimize, if not eliminate, snagging on underwater obstructions. It is to be noted that FIGS. 5-7 illustrate an anchor in which the leading edge snag inhibiting member 130 and shank 120 are effectively a unitary piece, i.e. the anti-snag aspect is achieved by shape of shank 120.

This embodiment further comprises an upper shank extension 150, rotatably connected to shank 120 by hinge 160. A mooring line can be attached to the anchor, typically by connecting the mooring line to upper shank extension 150 by a padeye and shackle or other similar means well known in the art. An elastic member 170 biases upper shank extension 150 toward a first position (as in FIG. 6), with a smaller shank angle. In the first position, anchor 100 can be drug into the soil (of a seafloor) at relatively low load, in the mode of an HHC. As the anchor sees increased soil resistance, the mooring load must be increased to generate further penetration. With increasing mooring load applied to the mooring line, elastic member 170 yields (or "stretches," when in the configuration shown here), the shank angle increases (i.e., the shank "opens up") and the fluke assumes a steeper dive angle into the soil, behaving in the manner of a VLA. This behavior creates an optimum embedment path for the anchor to achieve maximum holding capacity with the shortest span of drag resistance. Elastic member 170 may take various forms, within the purview of the invention; spring members, such as coil springs, or elastic media; it is further understood that elastic member 170 may be positioned so as to be placed in compression, rather than tension. It is sufficient for this invention that some means for biasing upper shank extension 150 in a direction toward fluke 110 be provided.

Shear plates 180 (for example only, shear plates 180 are shown only on FIGS. 6 and 7) can be interposed at either or both ends of the connection of elastic member 170 to the anchor. When a predetermined load is reached on the elastic member, the shear plate shears, thereby preventing structural damage to the elastic member or to the anchor, and upper shank extension 150 is free to rotate on hinge 160.

Another attribute which may be incorporated into the embodiment of FIGS. 5-7 is means for releasably fixing upper shank extension 150 to shank 120, wherein the means for releasably fixing yields under a pre-determined load, and thereafter elastic member 170 controls the shank angle. In the preferred embodiment, the means for releasably connecting may comprise alignable holes 151 in upper shank extension 150 and shank 120, through which a shearable pin 152 may be placed. It can be readily appreciated that once sufficient force is applied to the mooring line to shear pin 152, then upper shank extension tends to rotate toward a more open position, as permitted by elastic member 170; this position is readily seen in FIG. 7. Other means for releasably connecting upper shank extension 150 and shank 120, such as shear plates and the like, could be used.

It is to be further understood that this embodiment of the present invention (namely, the hinge connection between the shank and the fluke) may be used not only in combination with the snag-resistant anchor described above, but also in combination with other, prior art configurations of HHC anchors (that is, such prior art HHC anchors that do not comprise the snag-resistant attributes of the anchor disclosed above).

Figure 8:
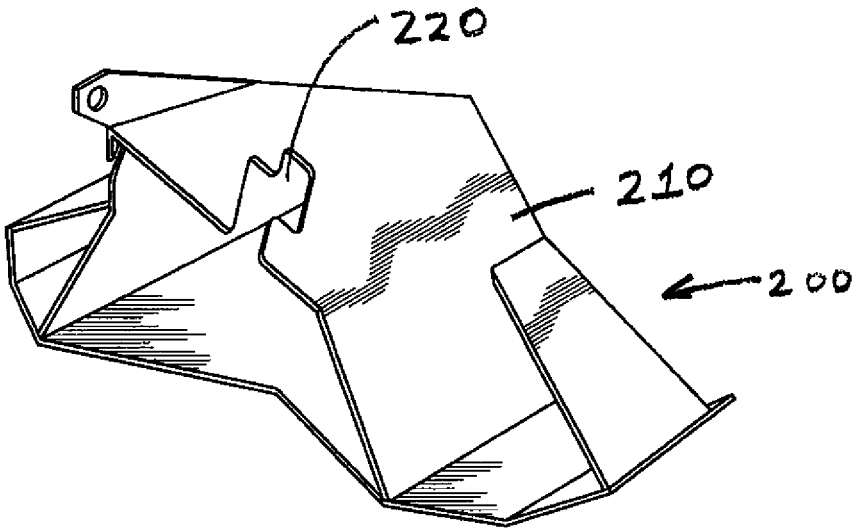
FIG. 8 is a perspective view of an anchor embodying the principles of another embodiment of the present invention herein disclosed.

An anchor comprising another embodiment of the present invention is shown in FIG. 8. When retrieved onto MODUs or other vessels, prior art HHC and VLAs were often racked on the vessels by hooking the flukes over a pipe, said pipe constituting an anchor rack. As is apparent from the previous description, anchors having the disclosed snag-resistant features are not adapted to be so hooked on a pipe or similar structure (such mounting is indeed very similar in concept to snagging a pipeline, which the anchors of the present invention are not susceptible to doing).

Disclosed is an anchor shank feature which can be incorporated into any embodiment of the present invention, including the anchors previously described. Referring to FIG. 8, anchor 200 (which may comprise any of the embodiments already disclosed) comprises a shank 210 having a generally Z-shaped racking notch 220 therein. Racking notch 220 permits anchor 200 to be lifted onto the vessel, then set down on an anchor rack, allowing the rack to slide into the Z-shaped groove, then lifted again to secure it in the anchor rack by engaging the bottom V-shaped groove in the Z-shaped notch. The advantages of the snag-resistant geometry described above are maintained; the shape and orientation of racking notch 220 is such that forward movement of anchor 200 does not present a potential snagging profile to an obstruction. Therefore, the addition of racking notch 220 to either of the anchor embodiments disclosed above does not reduce or impair the anti-snagging nature thereof, however gives the advantage of enabling simple and secure racking.

Figure 9:
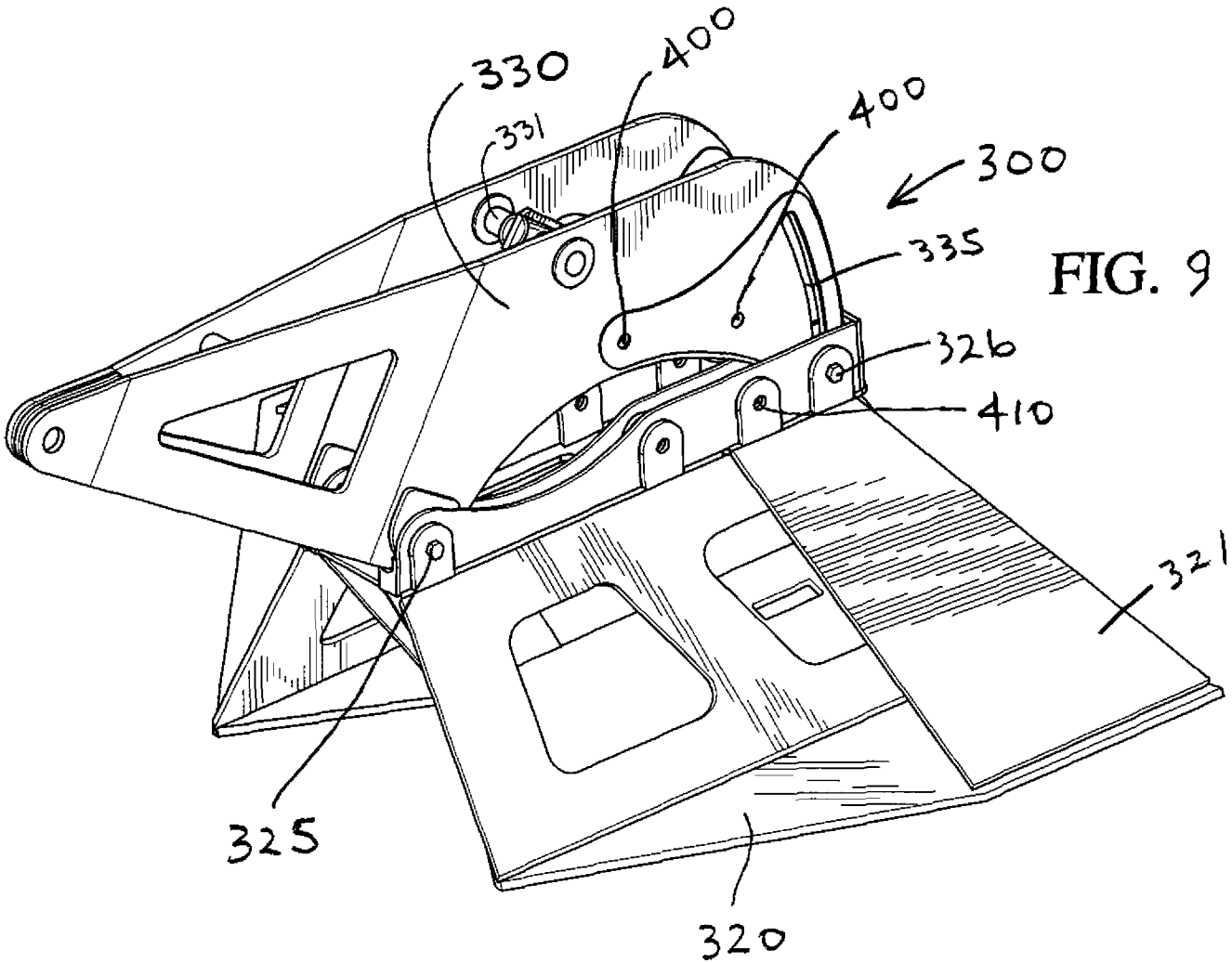
Figure 1D:
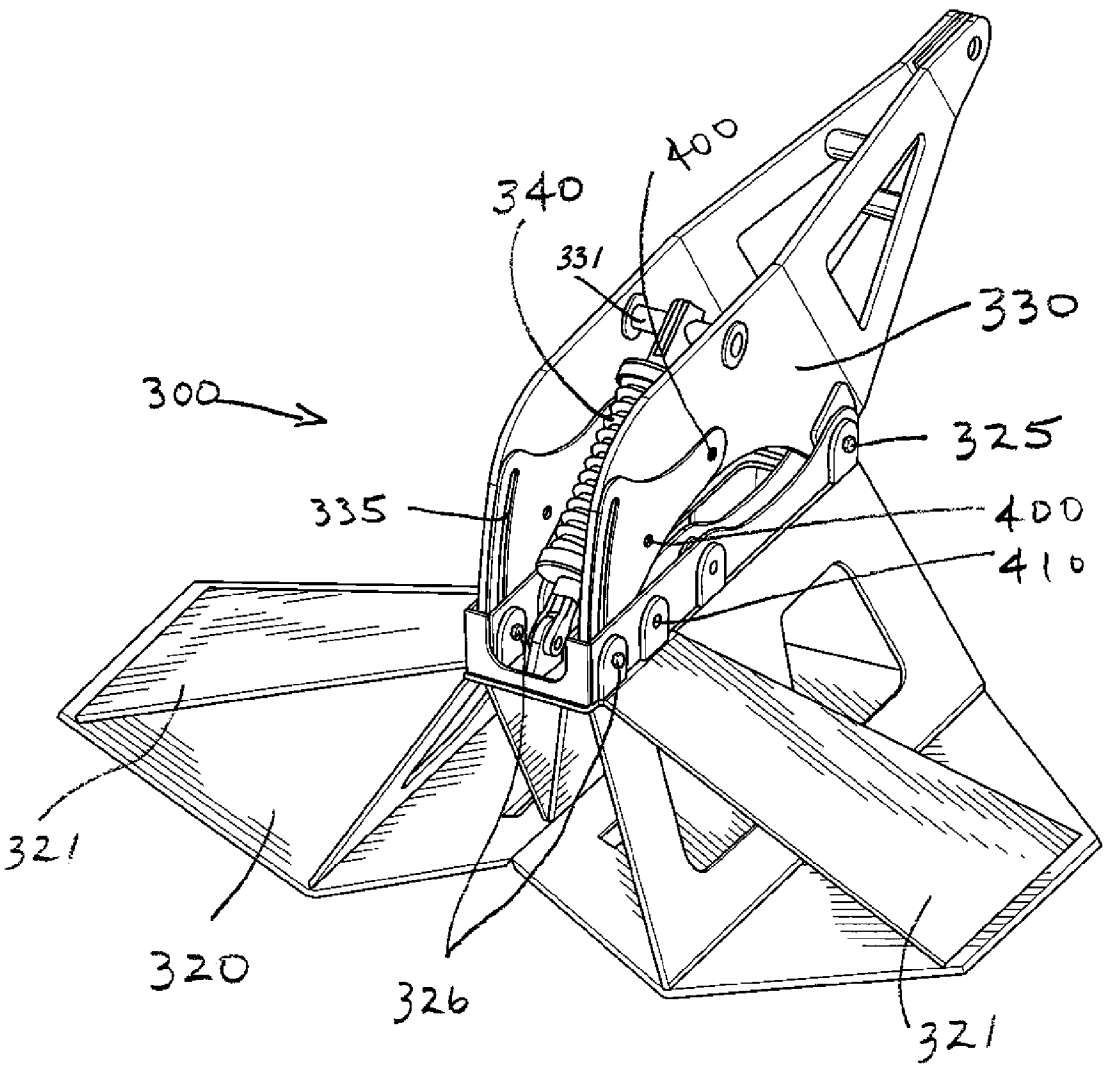
Figure 11:
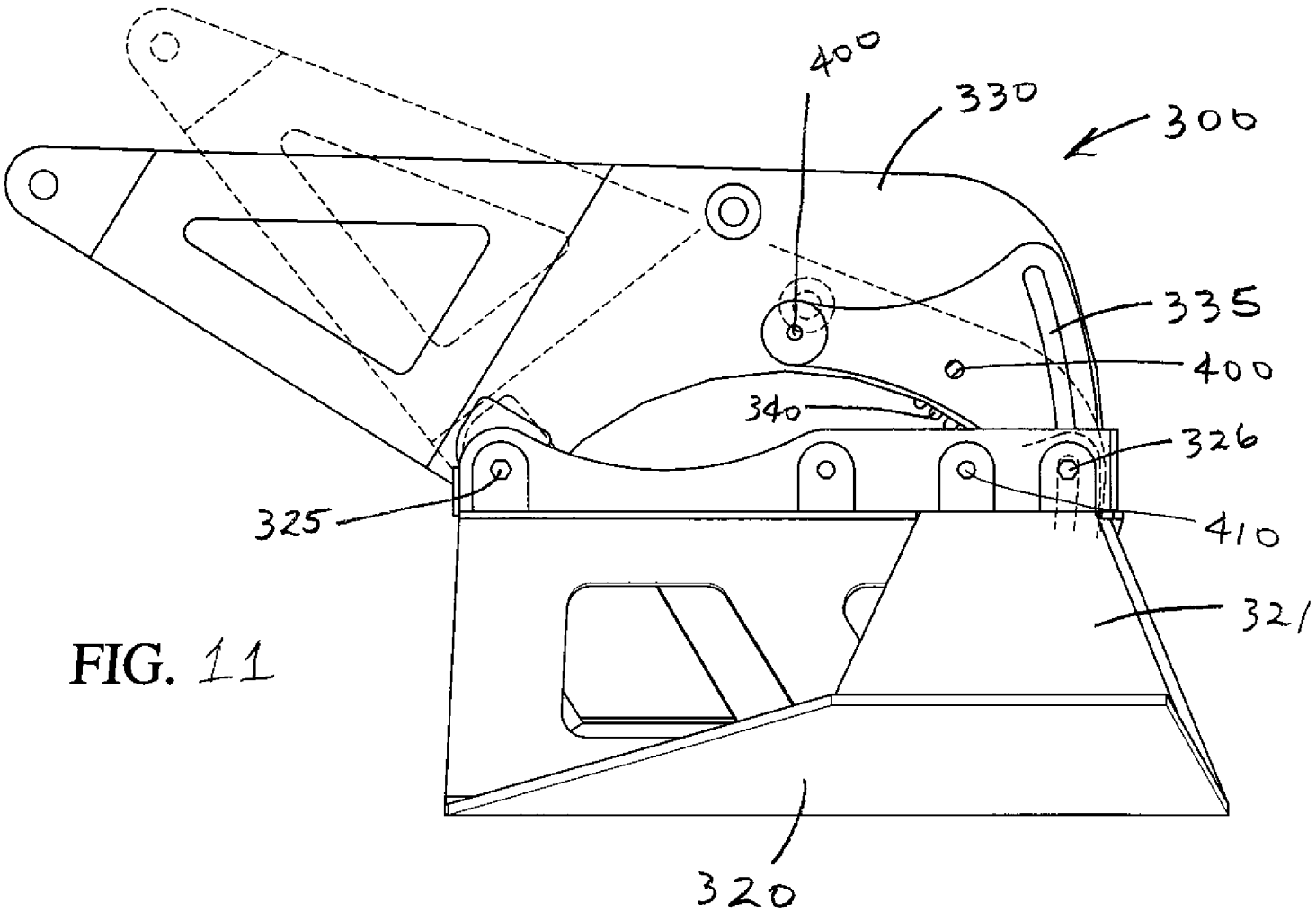

The final embodiment of the present invention is shown in FIGS. 9-11. Anchor 300, as in the earlier described embodiments, comprises a fluke 320 and a shank 330. Shank 330 is rotatably fixed to fluke 320, for example by the pinned connection 325. Lateral fluke snag inhibiting members 321 extend from fluke 320 to shank 330. As can be seen in FIG. 11, this embodiment (as with the previously described embodiments) has a profile, when viewed from the side, which presents no hook-shaped aspect, therefore minimizes or eliminates any tendency for the anchor to snag any obstruction. An elastic member, in the figures shown as a coil spring 340, best seen in FIG. 10, biases shank 330 toward a first position in which shank 330 is in a relatively "closed" position (i.e. a small shank angle—shank angle being depicted in a preceding figure) with respect to fluke 320, as seen in FIGS. 9 and 10, and in the solid lines of FIG. 11. By way of further explanation, with reference to FIG. 11, spring 340 biases shank 330 toward a first position in which the angle of shank 330 with respect to fluke 320 is relatively small (reference is made to the preceding discussion with respect to FIGS. 3, 5, 6 and 7, further explaining the angular relationship between the shank and the fluke). Preferably, shank 330 comprises an arcuate slot 335 (preferably two such slots, as shown), into which a projecting member on fluke 320, such as a pin or through-bolt 326, projects. The projecting member, by its placement in the slot, serves to stabilize the rotation of the shank on the fluke. It is understood that in this embodiment, two projecting members are provided, riding in each of the slots.

This embodiment permits use of the anchor as a Vertically Loaded Anchor ("VLA"), in which a typical sequence of deployment is as follows: initially, shank 330 is held at a relatively small angle with respect to fluke 320, due to the biasing force from the elastic member. When tension is applied to a line attached to shank 330 of the anchor, flukes 320 start to embed into the sea floor and bury the anchor. With increased load, the angle between shank 330 and fluke 320 overcomes the force exerted by elastic member (as depicted, coil spring 340), and the shank starts to "open up" with respect to the fluke. Depending upon the amount and duration of the embedment force, the anchor behaves as a VLA.

The embodiment of FIGS. 9-11 comprises another attribute which will now be described. If desired, coil spring 340 can be removed or disconnected, and shank 330 can be rotated to a more upward, "open" position relative to fluke 320, as depicted by the phantom lines in FIG. 11. When rotated to a sufficient degree, holes 400 and 410 in shank 330 and fluke 320 are aligned, and a pin or similar means can be inserted through the holes, thereby holding shank 330 and fluke 320 in a desired, fixed angular position. Multiple sets of holes 400 can be provided in shank 330, as can be seen in the drawings, so that different angles between shank 330 and fluke 320 can be fixed, as desired. It is to be understood that two sets of holes 400 in shank 400 are shown for illustrative purposes only; any number can be provided. With the shank now fixed in angular relation to the fluke, the anchor acts as a conventional, drag type or embedment-type anchor.

If desired, a means for releasably connecting the elastic member to shank 330 may be employed. By way of example, said means for releasably connecting the elastic member may comprise a shearable pin 331 connecting coil spring 340 to shank 330. It is understood that shearable pin 331 could be at either or both ends of coil spring 340, or some other releasable means could be used. When the force exerted by coil spring 340 on shearable pin 331 exceeds the design shear load, pin 331 shears, and shank 330 is then free to rotate to its most open position (i.e. the position with the maximum shank angle), as represented by the phantom lines in FIG. 11. In that position, the uppermost end of slot 335 bears against through-bolt 326.

It is to be understood that the pinned-together connection between shank 330 and fluke 320 renders them releasably connected, one to the other, and permits easy interchangeability of different shanks with fluke 320. For example, shanks 330 having different shapes and dimensions of may be mated to fluke 330, to achieve a desired behavior (frequently referred to as "trajectory") of the anchor as it buries itself in the seafloor under load. By way of example, changing the length of shank 330 changes the length of the moment arm, and consequently the magnitude of the rotational force imparted on the anchor.

While the preceding description sets out specifics regarding certain embodiments of anchors embodying the concepts of the disclosed inventions, it is understood that other embodiments are possible without departing from the scope of the invention. For example, the particular shapes of the shank and fluke can be modified as desired; dimensions and weights can be changed to accommodate particular load requirements; materials can be altered; the anchor can be used to fix any desired object to a seafloor, whether a floating vessel, MODU, or a structure fixed to the seafloor, but necessitating anchors for additional fixing in place and stabilization.

Therefore, the scope of the inventions is not limited to the specific embodiment(s) set out herein, but only by the scope of the appended claims and their legal equivalents.

I claim:

1. An anchor for mooring objects in a marine environment, comprising:

a) a substantially planar fluke having leading and trailing edges and opposing side edges;

b) a shank attached to said fluke, said shank comprising two planar members joined at an upper edge, and lower edges spaced apart and attached to said fluke so as to form a triangular shape when viewed longitudinally, said shank further comprising a means for attachment to a mooring line, and wherein a leading edge of said shank members adjoins a leading edge of said fluke so as to form no hook shape, when said anchor is viewed in side profile, wherein said side edges of said fluke comprise upswept wings, and further comprising snag inhibiting members extending between said shank members and said upswept wings of said fluke side edges.

2. The anchor of claim 1, wherein said anchor, in top view, forms no hook shape.

3. The anchor of claim 2, wherein said fluke leading edge comprises a V-shaped profile.

4. The anchor of claim 3, wherein said shank planar members comprise openings.

5. The anchor of claim 1, wherein said fluke leading edge comprises a V-shaped profile.

6. An anchor for mooring of floating structures in a marine environment, comprising:

a) a substantially planar fluke having leading and trailing edges and opposing side edges comprising upswept wings;

b) a shank attached to said fluke, said shank comprising two planar members joined at an upper edge, and lower edges spaced apart and attached to said fluke so as to form a triangular shape when viewed longitudinally, said shank further comprising a means for attachment to a mooring line, and wherein a leading edge of said shank planar members adjoins a leading edge of said fluke so as to form no hook shape, when said anchor is viewed in side profile;

c) an upper shank extension rotatably attached to said shank; and d) an elastic member biasing said upper shank extension and said shank together, so as to decrease an angle between said upper shank extension and said fluke.

7. The anchor of claim 6, further comprising alignable holes in said said extension and said shank, whereby when said alignable holes in said shank extension and said shank are aligned, a pin is inserted therethrough, thereby rotably locking said shank extension to said shank and fixing the angle between said upper shank extension and said fluke.

8. The anchor of claim 7, wherein said pin is shearable upon a design load being placed thereon.

9. The anchor of claim 6, further comprising one or more shear plates connecting said elastic member to said shank.

10. The anchor of claim 6, further comprising one or more shear plates connecting said elastic member to said upper shank extension.

11. The anchor of claim 6, further comprising snag inhibiting members extending between said shank members and said upswept wings of said fluke side edges.

12. The anchor of claim 11, further comprising alignable holes in said said extension and said shank, whereby when said alignable holes in said shank extension and said shank are aligned, a pin is inserted therethrough, thereby rotably locking said shank extension to said shank and fixing the angle between said upper shank extension and said fluke.

13. The anchor of claim 12, wherein said pin is shearable upon a design load being placed thereon.

14. The anchor of claim 6, wherein said shank further comprises a generally Z-shaped notch, said notch aligned so that any obstruction encountered with a leading edge of said shank encounters no hook shaped profile in said notch.

15. A method for mooring objects in a marine environment, comprising:

a) providing an anchor comprising:

a substantially planar fluke having leading and trailing edges and opposing side edges;

a shank attached to said fluke, said shank comprising two planar members joined at an upper edge, and lower edges spaced apart and attached to said fluke so as to form a triangular shape when viewed longitudinally, said shank further comprising a means for attachment to a mooring line, and wherein a leading edge of said shank planar members adjoins a leading edge of said fluke so as to form no hook shape, when said anchor is viewed in side profile; and wherein said shank comprises an upper shank extension rotatably attached to said fluke, and further comprising an elastic member biasing said shank extension and said fluke together toward a closed position;

b) positioning said anchor on a seafloor, attached to a mooring line; and c) imparting a tension load onto said mooring line, whereby said anchor penetrates into said seafloor, said elastic member permitting an angle between said shank extension and said fluke to open and close in response to said tension load and the soil characteristics encountered by said anchor.

* * * * *